United States Patent [19]

Higashiguchi

[11] 4,201,810

[45] May 6, 1980

[54] TRANSFERABLE FLOCKED FIBER DESIGN MATERIAL

[76] Inventor: Shigehiko Higashiguchi, 4-2 Honjo 3-chome, Sumida-Ku Tokyo, Japan

[21] Appl. No.: 876,573

[22] Filed: Feb. 10, 1978

[30] Foreign Application Priority Data

Aug. 24, 1977 [JP] Japan ..... 52-101417

[51] Int. Cl.[2] ..... B44C 3/02

[52] U.S. Cl. ..... 428/90; 156/230; 156/234; 156/235; 156/240; 427/206; 428/914

[58] Field of Search ..... 428/90, 914; 156/230, 156/234, 235, 240; 427/206

[56] References Cited

U.S. PATENT DOCUMENTS

| | | | |
|---|---|---|---|
| 3,379,604 | 4/1968 | Weber | 428/914 |
| 4,035,532 | 7/1977 | Gregorian | 428/90 |
| 4,142,929 | 3/1979 | Otomine | 156/234 |

*Primary Examiner*—Marion E. McCamish

*Attorney, Agent, or Firm*—Pearne, Gordon & Sessions

[57] ABSTRACT

A transferable flocked fiber design material for decorative flocked fabric goods which includes a release support sheet, fibers releasably flocked on one surface of said support sheet through a water-soluble and water-dispersible adhesive and a thermoplastic and pressure-sensitive synthetic resin adhesive layer applied to the exposed ends of said fibers.

12 Claims, 8 Drawing Figures

TRANSFERABLE FLOCKED FIBER DESIGN MATERIAL

BACKGROUND OF THE INVENTION

This invention relates to transferable flocked fiber design materials for decorative flocked fabric products and more particularly, to transferable flocked fiber design materials to be transferred to or permanently flocked on articles to be decorated therewith such as shorts, skirts, drawers, sporting wears, pouches and the like goods (they will be referred to as "article" or "articles" hereinafter) by applying heat and pressure in a simple manner utilizing a domestic iron, for example.

Hithertofore, in order to directly decorate such an article as a skirt with a transferable flocked fiber design material, it was the conventional practice that individual fibers were flocked on one surface of a support base cloth formed of woven fabric, non-woven fabric or cloth by means of an adhesive, the thus obtained transferable flocked fiber design material was then cut into design pieces representing desired symbols, emblems, numerals, letters and/or the like markings, for example and the design pieces were finally sewn to an article to be decorated therewith. In an alternative conventional practice, a thermally adhesive synthetic resin layer was applied to or laminated onto the surface of the support base cloth opposite from the surface of the cloth on which the individual fibers were flocked, the thus obtained transferable flocked fiber design material was cut into design pieces representing desired symbols, emblems, numerals, letters and/or the like markings, for example and the design pieces were then applied to an article to be decorated therewith by applying heat and pressure to the design pieces with the adhesive resin layer in contact with the article.

However, the former has the disadvantages that the cut flocked fiber design pieces have to be sewn to the article to be decorated therewith requiring a skilled hand and a rather long time in doing so and accordingly, the operation efficiency is low and when the design pieces are sewn to the article by an unskilled worker an acceptable flocked fabric product cannot be sometimes produced. The latter has the disadvantages that since the design pieces are applied to the article to be decorated therewith by applying heat and pressure to the design pieces by a domestic iron, for example, with the thermally adhesive synthetic resin layer in contact with the article and support base cloth to melt the resin layer, it also takes a rather long time to heat and melt the resin layer resulting in damaging of the article and/or the flocked fibers in the design pieces. Furthermore, in the above-mentioned two types of flocked fiber design materials, since the support base cloth is present between the article and flocked fibers, the thickness of the complete flocked fabric product is increased by the thickness of the support base cloth, the fibers tend to fray after a long time use of the flocked fabric product and as a result, the designs comprising such fibers tend to become out of shape from an area or areas containing the frayed fibers.

SUMMARY OF THE INVENTION

Therefore, the present invention is to provide a flocked fiber design material which can effectively eliminate the disadvantages inherent in the conventional indirect transferable flocked fiber design materials and which can be simply transferred to or permanently flocked on an article to be decorated such as a skirt and the like.

One object of the present invention is to provide transferable flocked fiber design pieces which can be transferred to or permanently flocked on an article to be decorated therewith without any support base cloth interposed between the design pieces and article.

Another object of the present invention is to provide transferable flocked fiber design pieces which can be easily transferred to or permanently flocked on an article to be decorated therewith by applying heat and pressure to the design pieces by the use of a convenient heat and pressure application device such as a domestic iron or the like.

Another object of the present invention is to provide a transferable flocked fiber design material from which transferable flocked fiber design pieces representing desired symbols, emblems, numerals, letters and/or the like markings can be obtained without requiring any cutting operation.

A further object of the present invention is to provide a transferable flocked fiber design material in a simple manner and at less expense.

In order to attain the above objects, according to one embodiment of the present invention, there has been provided a transferable flocked fiber design material for flocked fabric products which is produced by applying a water soluble-water dispersible adhesive in a sol state in water to one surface of a release substrate or support sheet which may be formed of woven fabric, non-woven fabric, cloth, paper or the like material, releasably depositing individual fibers onto the exposed surface of the adhesive while the adhesive is in its moistened state in erect and closely adjacent relationship to each other by electrostatic blasting, for example, so as to releasably flock the fibers onto the support sheet and allowing the intermediate product to dry, and applying a thermoplastic and pressure sensitive synthetic resin layer to the exposed ends of the fibers in a molten state. In another embodiment of the invention, the molten thermoplastic and pressure sensitive synthetic resin adhesive layer is applied to selected ones of the exposed ends of the fibers in accordance with a desired design.

In a further modified embodiment of the present invention, the dissolved water soluble and water dispersible adhesive layer is applied to areas of the release support sheet surface selected in accordance with a desired design, the fibers are releasably deposited at one end onto the exposed surface of the selectively applied water soluble and water dispersible adhesive layer and the molten thermoplastic and pressure sensitive synthetic resin adhesive layer is applied to the exposed ends of the deposited fibers.

The above and other objects and attendant advantages of the present invention will be more readily apparent to those skilled in the art from a reading of the following detailed description in conjunction with the accompanying drawings which show preferred embodiments of the present invention for illustration purpose only, but not for limiting the scope of the same in any way.

PREFERRED EMBODIMENTS OF THE INVENTION

Figure 1:
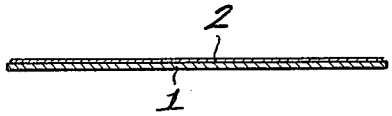
FIG. 1 is a cross-sectional view showing a first step in the production of a transferable flocked fiber design material according to the present invention in which a water soluble and water dispersible adhesive layer is applied to one surface of a release support sheet.
Figure 2:
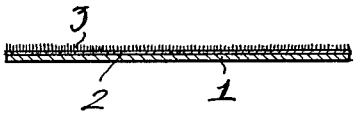
FIG. 2 is a cross-sectional view showing a second step in the production of the transferable flocked fiber design material in which fibers are releasably deposited onto the exposed surface of the adhesive layer so as to be releasably flocked on the release support sheet.
Figure 3:
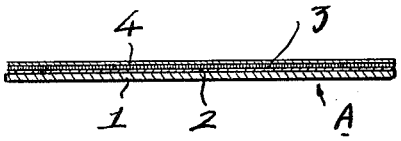
FIG. 3 is a cross-sectional view showing a third step in the production of the transferable flocked fiber design material in which a thermoplastic and pressure sensitive synthetic resin adhesive layer is applied to all the exposed ends of the flocked fibers.

The present invention will be now described referring to the accompanying drawings which show various steps in the production of transferable flocked fiber design materials according to the present invention and more particularly, to FIGS. 1 through 3 in which the steps in the production of one embodiment of transferable flocked fiber design material according to the present invention are shown. FIG. 1 shows a first step in the production of one embodiment of flocked fiber design material and in the first step, a water soluble and water dispersible adhesive layer 2 is applied in a sol state in water to the whole one surface of a release substrate or support sheet 1 which may be formed of a piece of cloth, woven fabric, non-woven fabric, paper or the like material employing a conventional screen printing process. In a second step as shown in FIG. 2, a number of individual fibers 3 are releasably deposited at one end onto the whole exposed surface of the adhesive layer 2 in erect and closely adjacent relationship to each other by electrostatic blasting, for example while the adhesive layer is in its moist state. In a third step as shown in FIG. 3, a thermoplastic and pressure sensitive synthetic resin adhesive layer 4 is applied in a molten state to all the exposed ends of the electrostatically deposited fibers 3 at an elevated temperature, that is, at the temperature of the melting point of the resin adhesive. After the application of the resin adhesive layer 4, the thus produced transferable fiber design material A is left as it is to allow the layer 4 to cool.

Figure 4:
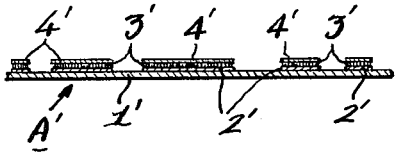
FIG. 4 is a cross-sectional view showing a modified embodiment of the present invention in which a water soluble and water dispersible adhesive layer is applied to selected areas of one surface of a release support sheet in a desired design, fibers are releasably deposited onto the exposed surface of the adhesive layer by electrostatic blasting, for example and a thermoplastic and pressure sensitive synthetic resin adhesive layer is applied to the exposed ends of the deposited fibers.

FIG. 4 shows a modified transferable flocked fiber design material A' produced by a first alternative method. In the production of the modified transferable flocked fiber design material A', a water soluble and water dispersible adhesive layer 2' which may be the same as the adhesive layer 2 in the transferable flocked fiber design material A of FIG. 3 is applied in a sol state in water to selected areas of one surface of a release support sheet 1' which may be also the same as the support sheet 1 in the design material A in accordance with a desired design by the employment of the conventional screen printing process. A number of fibers which may be the same as those employed in the design material A are releasably deposited at one end onto the exposed surface of the adhesive layer 2' at the selected areas of the support sheet surface in the same manner as described in connection with FIG. 2 while the adhesive 2' is in its moist state. A thermoplastic and pressure sensitive synthetic resin adhesive layer 4' is applied to the exposed ends of the deposited fibers 3' at the temperature of the melting point of the resin adhesive and the thus produced transferable flocked fiber design material A' is left as it is to allow the resin adhesive layer to dry.

Figure 5:
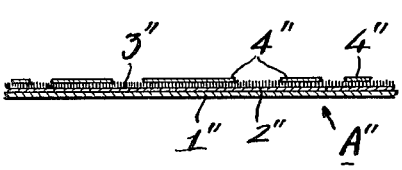
FIG. 5 is a cross-sectional view showing a further modified embodiment of the present invention in which a water soluble and water dispersible adhesive layer is applied to the entire one surface of a release support sheet, fibers are releasably deposited at one end onto the exposed surface of the adhesive layer and a thermoplastic and pressure sensitive synthetic resin adhesive layer is applied to the exposed ends of selected ones of the deposited fibers in accordance with a desired design.
Figure 5A:
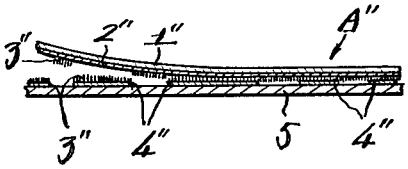
FIG. 5A is a cross-sectional view showing the manner in which the transferable flocked fiber design material as shown in FIG. 5 is applied to an article to be decorated therewith and thereafter, the release support sheet, water soluble and water dispersible adhesive layer and the rest of the fibers to the ends of which the thermoplastic and pressure sensitive adhesive layer is not applied are en block separated from the article leaving the thus produced flocked fiber design pieces permanently flocked on the article.

FIG. 5 shows a further modified transferable flocked fiber design material A" produced by a second alternative method and in the production of the design material A", a water soluble and water dispersible adhesive layer 2" is applied to the entire one surface of a release support sheet 1" in a sol state in water, a number of fibers 3" are releasably deposited at one end onto the entire exposed surface of the adhesive layer 2" in the same manner as mentioned in connection with FIG. 1. A thermoplastic and pressure sensitive synthetic resin adhesive layer 4" is applied in a molten state to the exposed ends of selected ones of the deposited fibers 3" in accordance with a desired design by the employment of a screen having the desired design therein. The materials of the support sheet 1", adhesive layer 2", fibers 3" and resin adhesive layer 4" may be the same as those of the corresponding components of the transferable flocked fiber design material A, respectively.

As to the material of the support sheet 1, 1' or 1" useful in the present invention, any of cloth, woven fabric, non-woven fabric or paper referred to hereinabove may be employed.

The water soluble and water dispersible adhesives useful in the present invention include carboxymethylcellulose (C.M.C.), casein, starch, rice-cake powder, acrylic resins, vinyl acetate resins and vinyl chloride resins, but the present invention is not limited to the use of such materials.

And when any one of the above-mentioned water soluble and water dispersible adhesives has added thereto any one of the below-mentioned additives, an adhesive having excellent releasable fiber holding and transferring properties can be obtained. These additives include polyethylene glycol, glycerine, ethylene glycol, kaolin powder and white carbon, for example.

The fiber materials useful in the present invention include glass particles and aluminum foils in addition to the above-mentioned individual fibers and these fibrous materials can be employed in their simple form or as mixtures thereof.

The thermoplastic and pressure sensitive synthetic resin adhesives useful in the present invention include one or more of acrylic resins, latex resins, vinyl acetate and vinyl chloride resins. When any one of these thermoplastic and pressure sensitive synthetic resin adhesives is added thereto thermoplastic resin adhesive powder such as powder of polyamide resin, ethylene resin or vinyl chloride resin adhesive powder or such additives are sprayed onto, said thermoplastic and pressure sensitive synthetic resin adhesive, and such adhesives in their molten state penetrate into the texture of an article and between the flocked fibers as the fibers of the flocked fiber design material are transferred to the article and when cooled or solidified, such adhesive mixtures firmly hold the transferred fibers on the article.

The thermoplastic and pressure sensitive synthetic resins such as acryl resins, latex resins, vinyl acetate resins and vinyl chloride resins enumerated hereinabove serve to cause the ends of the flocked fibers to be firmly held on the resins and to uniformly adhere to the article to be decorated.

When the flocked fiber design material is applied to an article to be decorated such as a shirt with the thermoplastic pressure sensitive synthetic resin adhesive layer 4 in contact with the shirt and is pressed against the shirt under heating, the above-mentioned powder of thermoplastic resin adhesive such as polyamide resin, ethylene resin or vinyl chloride resin sprayed over the thermoplastic pressure sensitive synthetic resin is melted and penetrates into the texture of the shirt and serves to cause the adhesive applied to the ends of the flocked fibers to adhere to an article (shirt) to be decorated when the flocked fibers are transferred onto the article. During this transferring operation, the thermoplastic and pressure sensitive synthetic resin adhesive layer firmly holds the flocked fibers in erect position.

Figure 3A:
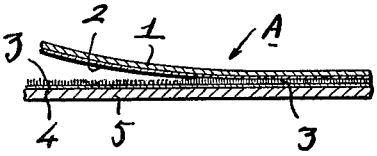
FIG. 3A is a cross-sectional view showing the manner in which the transferable flocked fiber design material which has passed through the first-third steps as shown in FIGS. 1 through 3 and has been cut to a desired design shape is applied to an article to be decorated therewith and thereafter, the release support sheet and water soluble and water dispersible adhesive layer are en block separated from the article leaving the fibers permanently flocked on the article in the desired design.

In transferring the transferable flocked fiber design material A as shown in FIG. 3 to an article such as a shirt or the like 5 (FIG. 3A) in accordance with a desired design, the design material A is first cut to the desired design shape by any suitable conventional cutting means, the cut design material A is then applied to the shirt with the thermoplastic-pressure sensitive synthetic resin adhesive layer 4 in contact with the shirt and is pressed against the shirt under heating and pressure conditions by the employment of a domestic iron or any other conventional hot pressing means to thereby cause the releasably flocked fibers to be permanently flocked on the shirt in the desired design shape.

By the ironing operation, the thermoplastic and pressure sensitive synthetic resin adhesive in the layer 4 melts and infiltrates into the texture of the shirt 5 and between the individual fibers 3 to provide strong bonds between the shirt and flocked fibers and between the individual fibers after the shirt and fibers have been left to cool. The appearance of the thus flocked and transferred fibers is the same as that of the fibers when the fibers were flocked by the conventional fiber flocking method in which an adhesive in a molten state was first applied to a selected area of a shirt in a desired design shape and the fibers were then flocked on the shirt while the adhesive was in its molten state. After cooling, the release support sheet 1 and water soluble and water dispersible adhesive layer 2 are en block separated from the shirt 5 leaving the flocked and transferred fibers 3 on the shirt 5. The separation of the support sheet 1 and adhesive layer 2 can be easily performed without difficulty because the material of the adhesive layer 2 has an adhesion just sufficient to temporarily or releasably hold the fibers on the release support sheet whereby the flocked fibers represent the desired design shape (see FIG. 3A).

Figure 4A:
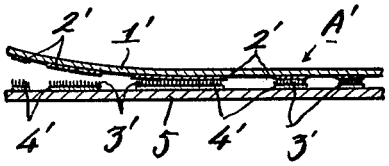
FIG. 4A is a cross-sectional view showing the manner in which the transferable flocked fiber design material as shown in FIG. 4 is applied to selected areas of an article to be decorated therewith and thereafter, the release support sheet and water soluble and water dispersible adhesive layer are en block separated from the article leaving the thus produced fiber design pieces permanently flocked on the article.

In the transfer of the modified embodiment of transferable flocked fiber design material A' (FIG. 4) which was produced by applying the water soluble and water dispersible adhesive layer 2' to selected areas of one surface of the release support sheet 1' in accordance with a desired design, releasably depositing or flocking the fibers 3 at one end onto the adhesive layer 2' and applying the thermoplastic and pressure sensitive synthetic resin adhesive layer 4' to the exposed or free ends of the fibers 3', the fibers 3' can be permanently flocked on an article 5 such as a shirt by applying the material A' to the shirt 5 with the resin layer 4' in contact with the shirt and applying heat and pressure to the material A' (see FIG. 4A). The support sheet 1' and adhesive layer 2' of the flocked fiber design material A' can be separated from the shirt 5 in the same manner as mentioned in connection with FIG. 3A, but in this case, the support sheet 1' and adhesive layer 2' are separated so as to leave the flocked fibers 3' in the desired design shape on the article 5 to thereby eliminate the cutting of the flocked fiber design material to the desired design, which is necessary in the first embodiment A.

In the transfer of the further modified embodiment of transferable flocked fiber design material A" of FIG. 5 which was produced by applying the water soluble and water dispersible adhesive layer 2" to the entire one surface of the release support sheet 1", releasably depositing the fibers 3" at one end onto the adhesive layer 2" and applying the thermoplastic and pressure sensitive synthetic resin adhesive layer 4" to the exposed ends of only the fibers 3" selected in accordance with a desired design the flocked fiber design material A" is applied to the shirt 5 with the adhesive layer 4" in contact with the shirt, pressed against the shirt under heating and pressurizing conditions and thereafter, the release support sheet 1" and adhesive layer 2" are en block separated from the shirt. However, in this embodiment, since the resin adhesive layer 4" is applied to only the selected fibers 3", the rest of the fibers 3" to which the resin adhesive layer 4" was not applied is also separated from the shirt together with the release support sheet and adhesvie layer 2" when the sheet and layer 1', 2" are separated from the shirt so as to leave only the selected fibrs 3" on the shirt in the desired design, to thereby provide a complete flocked fabric product (see FIG.

5A). As clear from the foregoing description of the modified embodiments A′ and A″, in the transfer of these materials to the shirt, the cutting step to the desired design shape, which is necessary for the material A of FIG. 3 can be eliminated.

The present invention has the following advantages over the conventional flocked fiber design materials:

1. The flocked fiber design materials can be simply transferred to an article to provide a complete flocked fabric product by the employment of a simple heating means such as a domestic iron, for example.
2. Since the fibers transferred to the article are directly applied in a desired design shape without any intermediate medium such as the base cloth present between the design and article, the design formed by such fibers is free of any deformation which may otherwise occur when such an intermediate medium is present.
3. Since the thermoplastic and pressure sensitive resin adhesives referred to hereinabove immediately harden after the adhesives have once melted and then cooled, the resins remain dry and will not collect dust and thus, the article is free of smears. And especially, the resin adhesives will not come off the article even when the article is subjected to washing such as dry cleaning and/or abuse as well as ordinary washing.
4. Since the desired design or designs comprising the fibers are directly transferred to the article without any intermediate medium such as the base cloth present between the design and article the design or designs are free of any permanent deformation even when the design or designs have been stretched of shrunk because the design or designs have the inherent elasticity.
5. The flocked fiber design or designs fibers can be printed with a design in multi-color or monocolor and any one of the above-mentioned thermoplastic and pressure sensitive resin adhesive can be then applied to the exposed ends of the printed fibers.

While several embodiments of the invention have been shown and described in detail, it will be understood that the same are for illustration purposes only and not to be taken as a definition of the invention, reference being had for this purpose to the appended claims.

What is claimed is:

1. A transferable flocked fiber design material for transfer to an article to be decorated with said design material in a desired design comprising:

a release support sheet;

a number of fibers releasably flocked at one end to one surface of said support sheet in erect and closely adjacent relationship to each other through a water soluble and water dispersible adhesive; and a thermoplastic and pressure sensitive synthetic resin adhesive layer applied to the ends of said fibers opposite to said support sheet;

characterized in that a thermoplastic resin adhesive powder is applied to said thermoplastic and pressure sensitive synthetic resin adhesive layer so as to cooperate with the latter in transferring said flocked fibers to an article to be decorated, whereby when said transferable flocked fiber design material is applied to the article and pressed there-against under heating, said thermoplastic resin adhesive powder melts and penetrates into the texture of the article while the flocked fibers are being held in erect position by said thermoplastic and pressure sensitive synthetic resin adhesive and when allowed to cool or solidify, the adhesive mixture firmly holds the transferred fibers on the article; and at least said thermoplastic and pressure sensitive synthetic resin adhesive layer is in the form of a desired design.

2. The transferable flocked fiber design material for transfer to an article to be decorated with said design material in a desired design as set forth in claim 1, in which said fibers are releasably flocked on said support sheet by electrostatic blasting.

3. The transferable flocked fiber design material for transfer to an article to be decorated with said design material in a desired design as set forth in claim 1, in which said water soluble and water dispersible adhesive is applied to selected areas of one surface of said release support sheet in accordance with said desired design and said fibers are releasably deposited on the exposed surface of said water soluble and water dispersible adhesive at said selected areas of the release support sheet.

4. The transferable flocked fiber design material for transfer to an article to be decorated with said design material in a desired design as set forth in claim 1, in which said release support sheet is formed of a member selected from the group comprising cloth, woven fabric, non-woven fabric and paper.

5. The transferable flocked fiber design material for transfer to an article to be decorated with said design material in a desired design as set forth in claim 1, in which said fibers are releasably flocked to said one surface of said support sheet in accordance with said desired design.

6. The transferable flocked fiber design material for transfer to an article to be decorated with said design material in a desired design as set forth in claim 1, in which said water soluble and water dispersible adhesive is formed of a member selected from the group comprising carboxymethylcellulose, casein, starch, rice-cake powder, acrylic resins, vinyl acetate resins and vinyl chloride resins.

7. The transferable flocked fiber design material for transfer to an article to be decorated with said design material in a desired design as set forth in claim 1, in which said water soluble and water dispersible adhesive contains an additive selected from the group comprising polyethylene glycol, glycerine, ethylene glycol, kaolin powder and white carbon.

8. The transferable flocked fiber design material for transfer to an article to be decorated with said design material in a desired design as set forth in claim 1, said fibers are formed of a member selected from the group comprising glass fibers and aluminum foils.

9. The transferable flocked fiber design material for transfer to an article to be decorated with said design material in a desired design as set forth in claim 1, in which said thermoplastic and pressure sensitive synthetic resin adhesive layer is formed of one or more members selected from the group comprising acrylic resins, latex resins, vinyl chloride resins and vinyl acetate resins.

10. The transferable flocked fiber design material for transfer to an article to be decorated with said design material in a desired design as set forth in claim 1, in which said thermoplastic resin adhesive powder is selected from the group consisting of polyamide resins and ethylene resins.

11. The transferable flocked fiber design material for transfer to an article to be decorated with said design material in a desired design as set forth in claim 1, in which said thermoplastic and pressure sensitive synthetic resin layer is applied to the ends of selected ones of said flocked fibers opposite to said support sheet in accordance with said desired design.

12. The transferable flocked design material for transfer to an article to be decorated with said design material in a desired design as set forth in claim 1, in which one of said water soluble adhesive, flock, and resin adhesive layer is in the form of said desired design.

* * * * *